US006202585B1

(12) United States Patent
Alan

(10) Patent No.: US 6,202,585 B1
(45) Date of Patent: Mar. 20, 2001

(54) RUBRAIL MOORING LINE RECEPTACLE APPARATUS

(76) Inventor: Brad Alan, 1205 Orchard Ct., Columbus, MI (US) 48063

( * ) Notice: Subject to any disclaimer, the term of this patent is extended or adjusted under 35 U.S.C. 154(b) by 0 days.

(21) Appl. No.: 09/374,830

(22) Filed: Aug. 14, 1999

Related U.S. Application Data

(63) Continuation-in-part of application No. 09/026,596, filed on Feb. 20, 1998, now Pat. No. 6,041,729, which is a continuation-in-part of application No. 08/791,973, filed on Jan. 31, 1997, now Pat. No. 5,988,094, which is a continuation-in-part of application No. 08/540,081, filed on Oct. 6, 1995, now Pat. No. 5,598,805.

(51) Int. Cl.[7] ..... B63B 59/02
(52) U.S. Cl. ..... 114/219; 114/230.2
(58) Field of Search ..... 114/219, 230.2, 114/230.25, 218

(56) References Cited

U.S. PATENT DOCUMENTS

| | | | | |
|---|---|---|---|---|
| 2,832,116 | | 4/1958 | Clevett, Jr. et al. . | |
| 2,959,146 | * | 11/1960 | Erkert | 114/219 |
| 3,012,736 | | 12/1961 | Brust . | |
| 3,464,113 | | 9/1969 | Silverman et al. . | |
| 3,841,685 | | 10/1974 | Kolodziej . | |
| 3,897,745 | | 8/1975 | Hutchings . | |
| 4,084,533 | * | 4/1978 | Boyer | 114/219 |
| 4,109,603 | | 8/1978 | Guthman . | |
| 4,114,553 | | 9/1978 | Zikek . | |
| 4,173,194 | | 11/1979 | McLanghlin . | |
| 4,519,643 | | 5/1985 | Harris . | |
| 4,648,159 | | 3/1987 | Dougherty . | |
| 4,741,284 | | 5/1988 | Madison . | |
| 4,912,816 | | 4/1990 | Brandt . | |
| 5,050,813 | | 9/1991 | Ishikawa et al. . | |
| 5,116,260 | | 5/1992 | Upchurch . | |
| 5,598,805 | | 2/1997 | Obrinski . | |
| 5,730,077 | * | 3/1998 | Nunes et al. | 114/219 |
| 5,870,963 | | 2/1999 | Alan . | |

OTHER PUBLICATIONS

Wellcraft Marine Catalog of Wellcraft Marine Co, Sarasaota, FL 34243 Dated: 1989.

Wellcraf Marine Boat, Date Uknown but Believed Dated Approximatey 1989.

* cited by examiner

*Primary Examiner*—Sherman Basinger
(74) *Attorney, Agent, or Firm*—Peter D. Keefe

(57) ABSTRACT

A rubrail mooring line receptacle apparatus integrating a rubrail with a mooring line receptacle. A pair of bow mooring lines are connected at their respective near ends to the bow of the watercraft, for example via respective starboard and port cleats, or via a centrally located bow eyelet. The distal end of the bow mooring lines are preferably connected adjustably to an abutment member, preferably in the form of a handle, which is snappably held in place at the gunwale. Port and starboard rubrail mooring line receptacles include a sidewall, a rubrail member integral with a lower portion of the sidewall, and, preferably, a flange member connected to an upper portion of the sidewall. The rubrail member is robust and preferably provides internal and external curvilinear surfaces, wherein the internal surface provides an interior hollow which is preferably concave and is sized to restably receive a bow mooring line therein. A longitudinal slot is provided between the rubrail member and the flange member, which is larger than the diameter of the bow mooring lines. The sidewall is attached to the gunwale of a selected watercraft via a suitable attachment modality. Where bow cleats are used, it is preferred to include a guide member to assist initial entry of the bow mooring line into its respective port or starboard rubrail mooring line receptacle. A preferred material for the port and starboard rubrail mooring line receptacles is a sturdy, ultraviolet resistant material, as for example polyvinylchloride (PVC) having a hardness of 80–85 shore A.

13 Claims, 7 Drawing Sheets

RUBRAIL MOORING LINE RECEPTACLE APPARATUS

CROSS REFERENCE TO RELATED APPLICATIONS

The present patent application is a continuation-in-part application of Ser. No. 09/026,596, filed on Feb. 20, 1998, which is now U.S. Pat. No. 6,041,729, which application is a continuation-in-part application of Ser. No. 08/791,973, filed on Jan. 31, 1997, which is now U.S. Pat. No. 5,988,094 and which application is a continuation-in-part application of Ser. No. 08/540,081, filed on Oct. 6, 1995, which is now U.S. Pat. No. 5,598,805.

BACKGROUND OF THE INVENTION

1. Field of the Invention

The present invention relates to rubrails used as bumpers at the gunwale of watercraft and to mooring lines used for mooring watercraft to dock facilities, and more particularly to a combined rubrail and mooring line receptacle apparatus for storing the mooring line in a ready to use outstretched configuration when the mooring line is not in use.

2. Description of the Prior Art

Watercraft, such as motor and sail boats, utilize fore and aft mooring lines at each of the port and starboard sides thereof to secure the watercraft to a dock facility. In this regard, the dock facility generally has a number of cleats or other structures, such as pilings, to which mooring lines of the watercraft may be connected.

Typically, a watercraft will have a mooring line for being connected with cleats on the watercraft in anticipation of future and present docking needs. Cleats are usually provided fore and aft at each of the starboard and port sides of the watercraft, whereupon four mooring lines would be needed to be connected to these four cleats.

Rubrails are located at the gunwale of a watercraft and serve as bumpers when the watercraft comes alongside some object, such as for example a dock or another watercraft. Usually, rubrails are composed of an elastomeric material so as to absorb and manage minor impacts, and they extend usually around the entire perimeter of the watercraft, with the possible exception of the stern. Rubrails may be connected to the gunwale by fasteners or another fastening modality, such as an adhesive.

Problematically, when a skipper leaves dock, the mooring lines may be loosely placed on the boat deck, whereafter they may slide off and then dangle into the water. Dangling mooring lines are, of course, unsightly and they can add drag and pose other problems to operation of the watercraft. On the other hand, if the mooring lines are secured to some component of the boat deck to prevent potential dangling, then when the mooring lines need to be made ready for docking considerable time and effort must be expended to free the lines. This lost time could be critical if a skipper is in need of a fast securement to the dock in the event of an untoward docking situation, such as when other boats may limit free navigation or high seas or winds make docking particularly tricky. Generally, the stern mooring lines are easily accessible by the passengers, as they are located at the ingress/egress area of the watercraft. But, the bow mooring lines are remotely located, and frequently require someone to walk the deck to the front of the watercraft, which can involve some danger, and may also involve delay in deploying the bow mooring line or lines.

Accordingly, what is needed in the art is some effective, simple and easy to use a rubrail to hold mooring lines in a stored state, yet be instantly available when docking is imminent.

SUMMARY OF THE INVENTION

The present invention is a rubrail which provides an effective, simple and easy to use mooring line receptacle, wherein at least the bow mounted mooring lines are instantly available when docking is imminent.

The rubrail mooring line receptacle apparatus according to the present invention is mounted on the gunwale at the starboard and port sides of a watercraft, each integrating a rubrail with a mooring line receptacle. While the rubrail mooring line receptacle may be continuous at the starboard and port sides of the vessel, and even the stern, it may be formed of a plurality of discrete segments. In a preferred form, the rubrail mooring line receptacle is in the form of at least two discrete segments, defined by a gap provided generally at the ingress/egress location of the watercraft.

A pair of bow mooring lines are connected at their respective near ends to the bow of the watercraft, for example via respective starboard and port cleats, or via a preferably centrally located bow eyelet, of which there may be more than one, such as for example one for the port side and one for the starboard side of the bow. The distal end of the bow mooring lines are preferably connected adjustably to an abutment member, preferably in the form of a handle, which is snappably held in place at the gunwale between the respective port and starboard gap of each of the rubrail mooring line receptacles.

The port and starboard rubrail mooring line receptacles include a sidewall, a rubrail member integral with a lower portion of the sidewall, and, preferably, a flange member connected to an upper portion of the sidewall. The rubrail member is robust and preferably provides internal and external curvilinear surfaces, wherein the internal surface provides an interior hollow which is preferably concave and is sized to restably receive a bow mooring line therein. A longitudinal slot is provided between the rubrail member and the flange member which, preferably, is larger than the diameter of the bow mooring lines, but the slot may be smaller than the bow mooring lines such that the bow mooring lines are pressable therethrough. The sidewall, which is opposite the slot, is attached to the gunwale of a selected watercraft via any suitable attachment modality, such as for example threaded fasteners, an adhesive or hardware connected with the watercraft into which the rubrail mooring line receptacle is retained. Where bow cleats are used, it is preferred to include a guide member to assist initial entry of the bow mooring line into its respective port or starboard rubrail mooring line receptacle.

A preferred material for the port and starboard rubrail mooring line receptacles is a sturdy, ultraviolet resistant material, as for example polyvinylchloride (PVC) having a hardness of 80–85 shore A. The bow mooring lines may be composed of any suitable line material used for nautical purposes, such as for example three strand nylon.

In operation, each of the port bow and starboard bow mooring lines have the proximate ends thereof looped over or otherwise connected with their respective cleat or a central bow eyelet on the watercraft. Each bow mooring line is then placed into its respective rubrail mooring line receptacle via the slot, and in the case of bow cleats, with the aid of the guide member. The respective handles are then snapped into place at the gap in the respective port and starboard rub rail mooring line receptacles.

When docking, the skipper or a crew member grabs a bow mooring line, via the handle thereof, on the side of the watercraft facing a dock facility, and then pulls upon the mooring line to thereby free it from its rubrail mooring line receptacle via exiting along the slot thereof. The person then secures that mooring line in a conventional way to the dock facility, such as for example at a dock cleat or dock piling. If appropriate, the other of the bow mooring lines is then grabbed at its respective handle and similarly deployed. The stern mooring lines are deployed in a conventional manner, but can be stored via the rubrail mooring line receptacle. When it is time to shove-off, the mooring lines tied to the dock facility are released therefrom, and the bow mooring line (or lines) is (are) then slipped progressively through the slot of its (their) respective rubrail mooring line receptacles for storage while the watercraft is underway, and later use when docking is to again take place.

Accordingly, it is an object of the present invention to provide a combined rubrail and mooring line receptacle apparatus for a watercraft which provides for bumper protection and easy, simple, outstretched storage of mooring lines in readiness for use when docking the subject watercraft.

It is another object of the present invention to provide a rubrail mooring line receptacle apparatus which provides convenient grabbing of mooring lines for rapid deployment during dockage of the subject watercraft.

These, and additional objects, advantages, features and benefits of the present invention will become apparent from the following specification.

DETAILED DESCRIPTION OF THE PREFERRED EMBODIMENT

Figure 1:
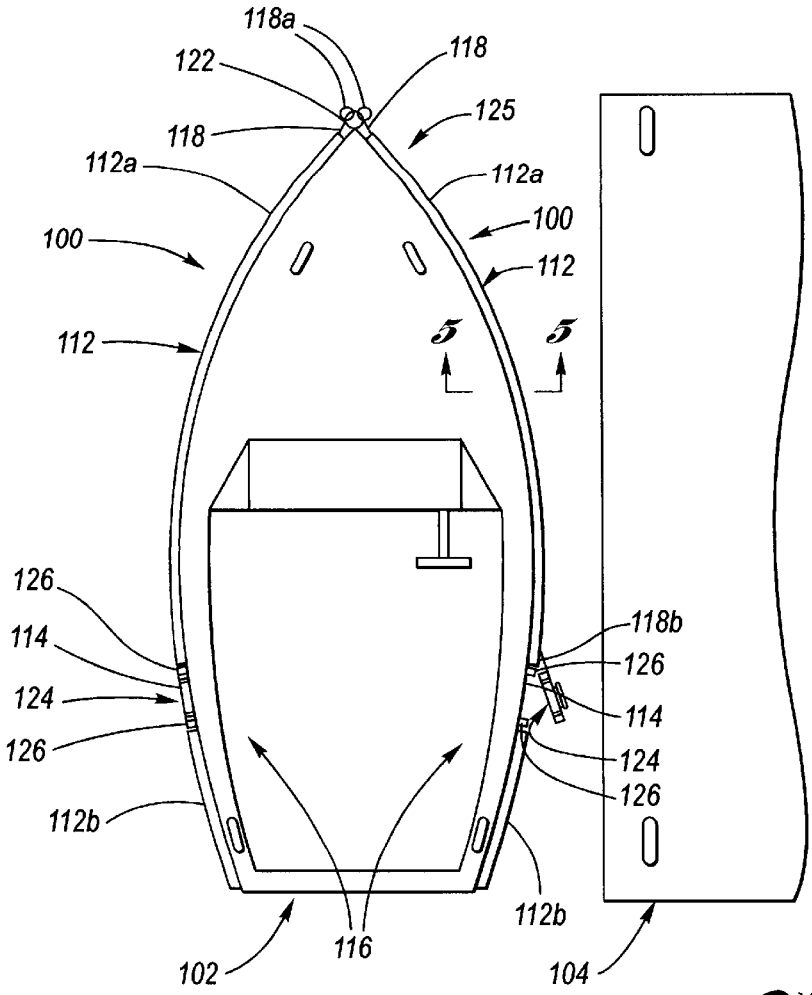
FIG. 1 is a top plan view of a watercraft equipped with a first rubrail mooring line receptacle apparatus according to the present invention.
Figure 2:
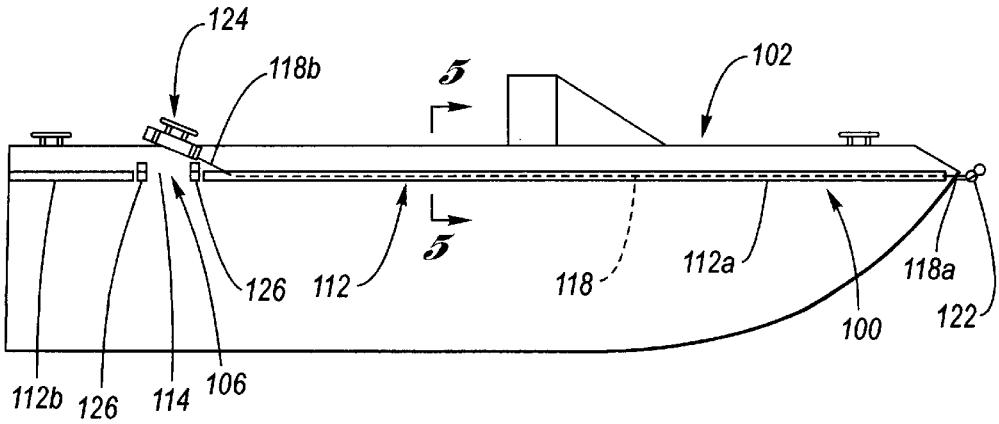
FIG. 2 is a side view of the watercraft of FIG. 1.
Figure 3:
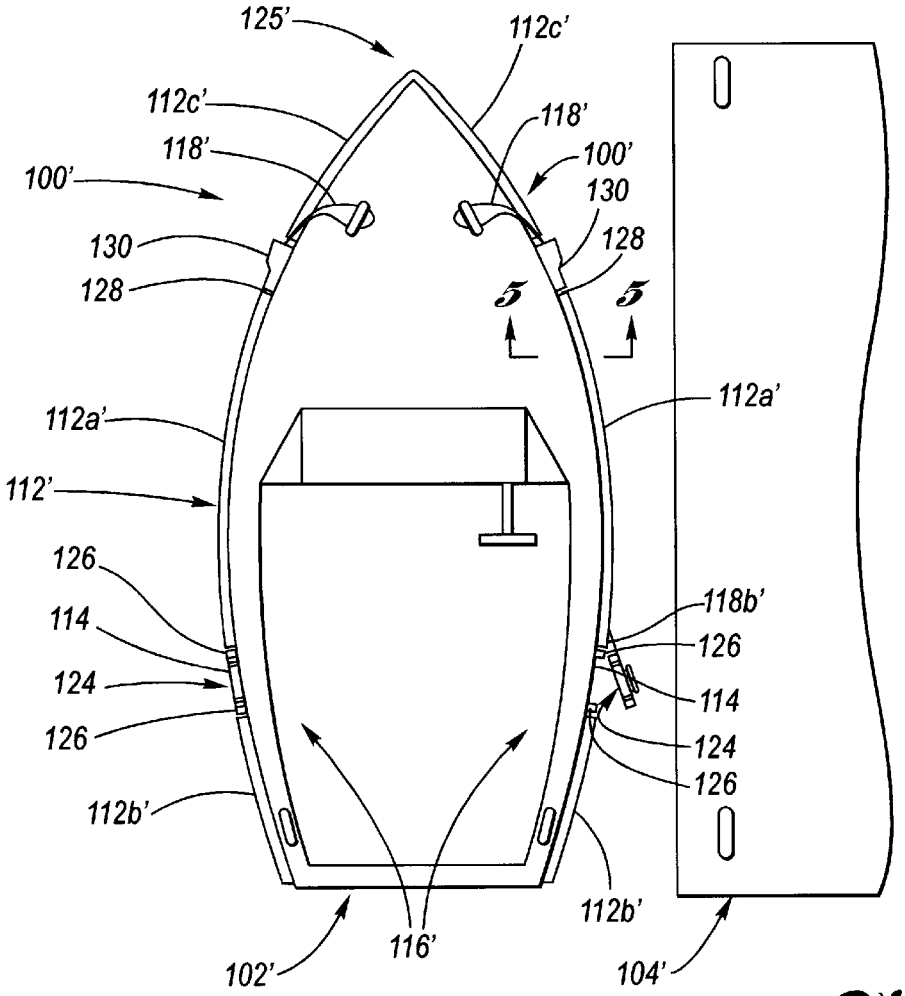
FIG. 3 is a top plan view of a watercraft equipped with a second rubrail mooring line receptacle apparatus according to the present invention.
Figure 4:
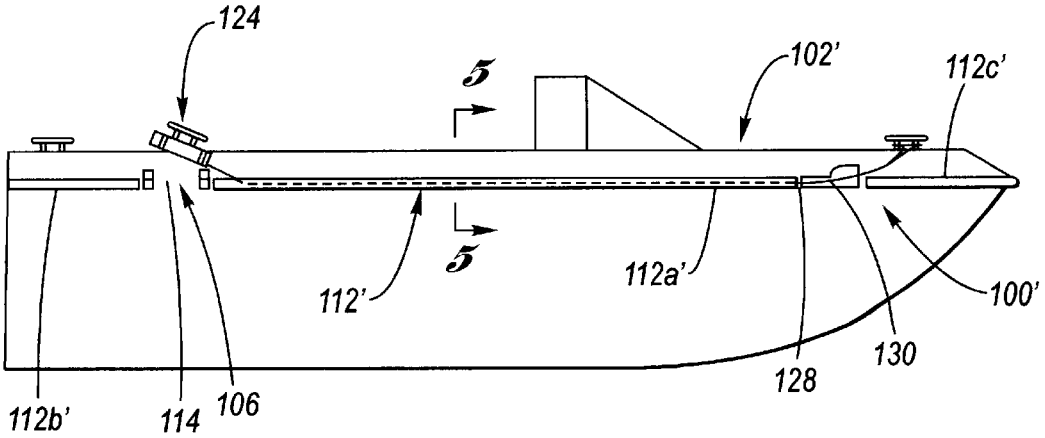
FIG. 4 is a side view of the watercraft of FIG. 3.
Figure 5:
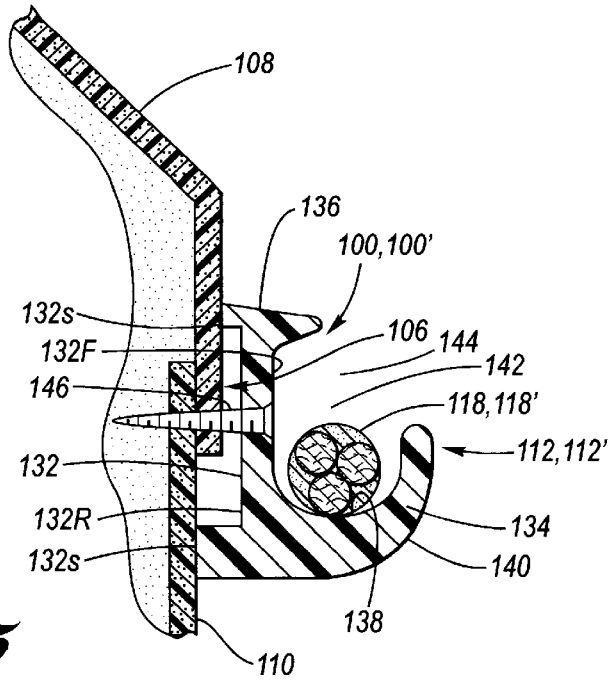
FIG. 5 is a sectional end view of the first and second rubrail mooring line receptacle apparatus, seen along any of lines 5—5 in FIGS. 1, 2, 3 and 4, shown in operation with a bow mooring line.

Referring now to the Drawing, FIGS. 1 through 4 generally depict the rubrail mooring line receptacle apparatus according to the present invention in operation with respect to a watercraft 102, 102' and a dock facility 104, wherein FIGS. 1 and 2 depict a first rubrail mooring line receptacle apparatus 100, and FIGS. 3 and 4 depict a second rubrail mooring line apparatus 100', each integrating a rubrail with a mooring line receptacle. The first and second rubrail mooring line receptacle apparatus 100, 100' are each respectively mounted to the watercraft 102, 102' at the gunwale 106 whereat is conventionally mounted a conventional rubrail, along both the port and starboard sides thereof. Commonly, the gunwale 106, as shown at FIG. 5, is where the deck 108 meets the hull 110, but this may vary from boat to boat.

Referring firstly to the first rubrail mooring line receptacle apparatus 100, shown at FIGS. 1 and 2, a rubrail mooring line receptacle 112 is in the form of a plurality of discrete receptacle segments 112*a*, 112*b*, wherein a gap 114 is provided generally at the ingress/egress location 116 of the watercraft 102. A pair of bow mooring lines 118 are connected at their respective near ends 118*a* to the bow 125 of the watercraft 102 via a centrally located bow eyelet 122 (or another mooring line fastening device, such as a cleat). The distal end portion 118*b* of the bow mooring lines 118 are connected adjustably to a handle 124, which is snappably held in place at the gunwale 106 by seats 126 located at either end of the respective port and starboard gaps 114 of the rubrail mooring line receptacles 112. It will be noticed that each of the bow mooring lines 118 are storably received, in an outstretched manner, by a respective rubrail mooring line receptacle 112. By merely grasping the handle 124, the mooring line becomes immediately available for use to moor the watercraft (see FIGS. 12*a* through 13*c*).

Referring secondly now to the second rubrail mooring line receptacle apparatus 100', shown at FIGS. 3 and 4, a rubrail mooring line receptacle 112' is in the form of a plurality of discrete receptacle segments 112*a'*, 112*b'*, 112*c'* wherein an identical gap 114 to that shown with respect to FIGS. 1 and 2 is provided generally at the ingress/egress location 116' of the watercraft 102'. A pair of bow mooring lines 118' are connected at their respective near ends 118*a'* to the bow cleats 120 of the watercraft 102'. The distal end 118*b'* of the bow mooring lines 118' are connected adjustably to a handle 124, which is identical to that shown in FIGS. 1 and 2, and which is snappably held in place at the gunwale 106 by seats 126 located at either end of the respective port and starboard gaps 114 of the rubrail mooring line receptacles 112'. A bow gap 128 is provided in the rubrail mooring line receptacle 112' adjacent the bow cleats 120, whereat is situated a guide member 130 to assist initial entry of the bow mooring lines 118' into their respective port or starboard rubrail mooring line receptacle. It will be noticed that each of the mooring lines 118' are storably received, in an outstretched manner, by a respective rubrail mooring line receptacle 112'. By merely grasping the handle 124, the mooring line becomes immediately available for use to moor the watercraft.

Now referring additionally to FIGS. 5 through 13C, the structure and function of the rubrail mooring line receptacle apparatus 100, 100' will be further elaborated.

As shown at FIG. 5, the port and starboard rubrail mooring line receptacles 112, 112' include a sidewall 132 having a rear side 132R and a forward side 132F, a rubrail member 134 is integral with the forward side of the sidewall at a lower portion thereof, and, preferably, a flange member 136 is connected to the forward side of the sidewall at an upper portion thereof. The rubrail member 134 is robust and preferably provides internal and external curvilinear surfaces 138, 140, wherein an interior hollow 142 formed by the rubrail member is sized to receive therein a bow mooring line 118, 118' so as to be restable upon the concavely shaped internal surface. A longitudinal slot 144 is provided between the rubrail member 134 and the flange member 136, which is larger than the diameter of the bow mooring lines 118, 118'. The rear side 132R of the sidewall 132, which is opposite the slot 144, is attached to the gunwale 106 of a watercraft via any suitable attachment modality, such as for example threaded fasteners 146, an adhesive, or retaining hardware. The rear side 132R may have steps 132S to interface smoothly and aliganably with the various watercraft surfaces formed at the gunwale 106.

The external surface 140 of the rubrail member 134 is preferably convex and provides a rubrail bumper for the watercraft as effective as that provided by a conventional rubrail, wherein the crush resistance due to an impact may be partly withstood by the presence of a mooring line lying in the internal hollow 142. It is preferred for the flange member 136 to not project from the gunwale as far as the external surface 140 of the rubrail member 134, as generally shown at FIG. 5, wherein the flange member assists keeping the mooring line received in the interior hollow as the watercraft may bounce upon the waves. However, the configuration of the rubrail mooring line receptacle may be varied from the preferred cross-sectional configuration as shown at FIG. 5 without departing from the scope of the intended disclosure herein presented, which is defined by the appended claims.

Figure 6A:
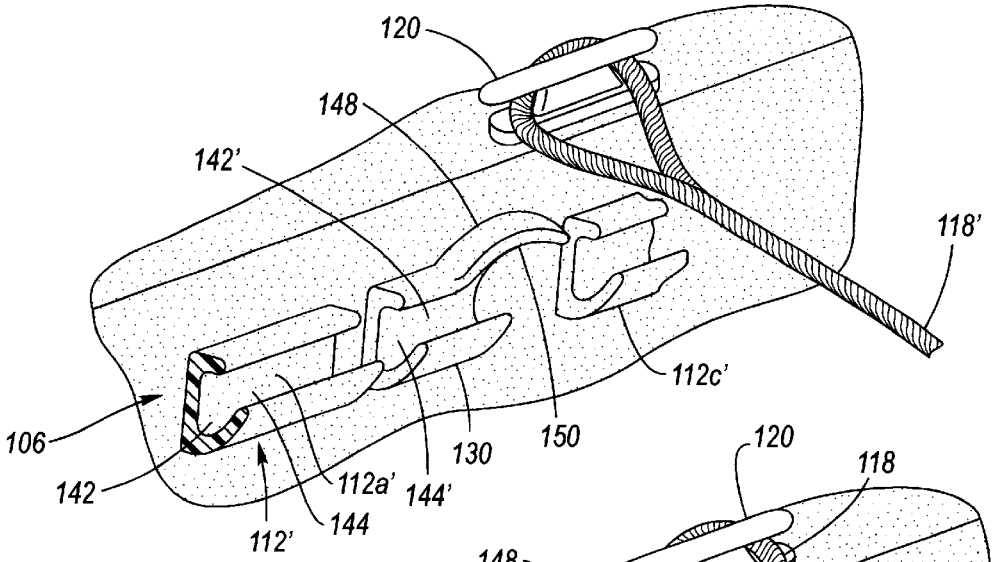
FIGS. 6A and 6B are partly sectional perspective views depicting the operation of a guide member of the second rubrail mooring line apparatus of FIGS. 3 and 4.
Figure 6B:
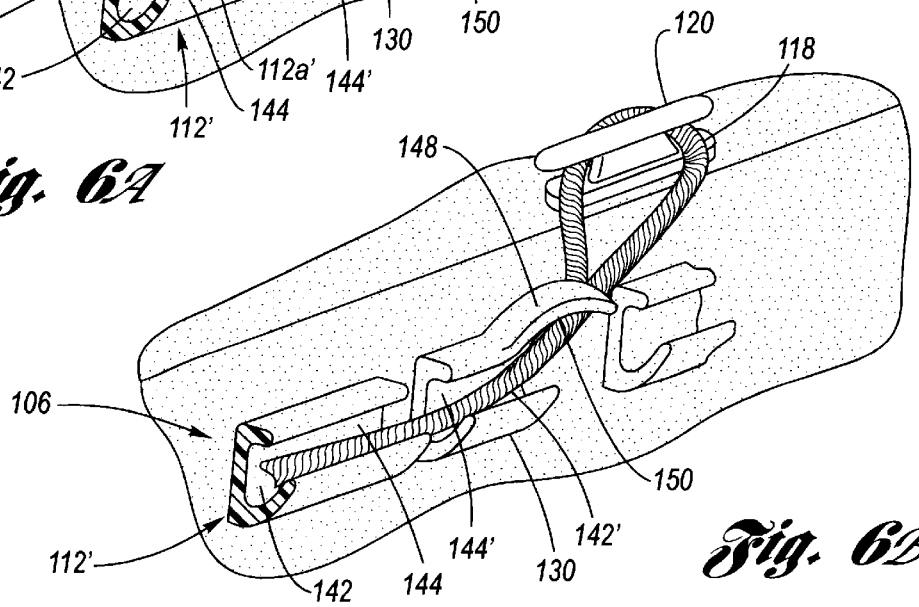
Figure 7:
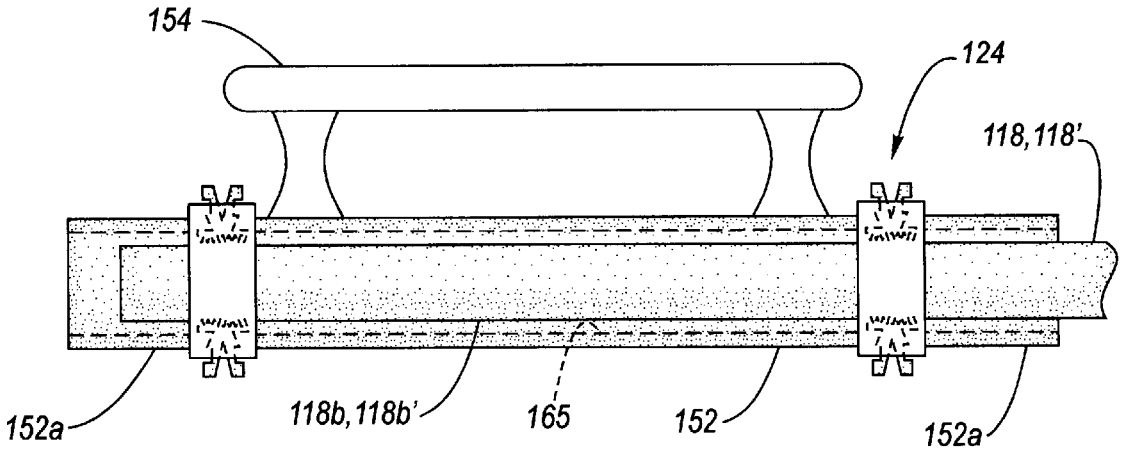
FIG. 7 is a side view of a handle according to the present invention for connecting to a distal end of a bow mooring line.
Figure 8:
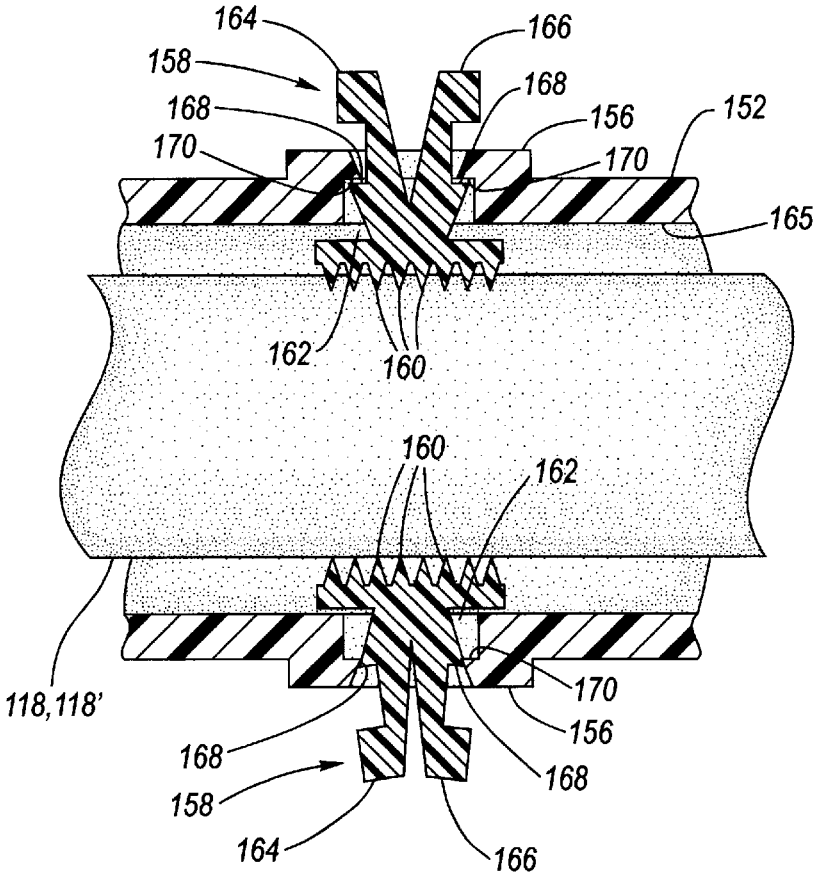
FIG. 8 is a broken-away detail side view showing a mooring line adjustment and retention mechanism of the handle according to the present invention.
Figure 9:
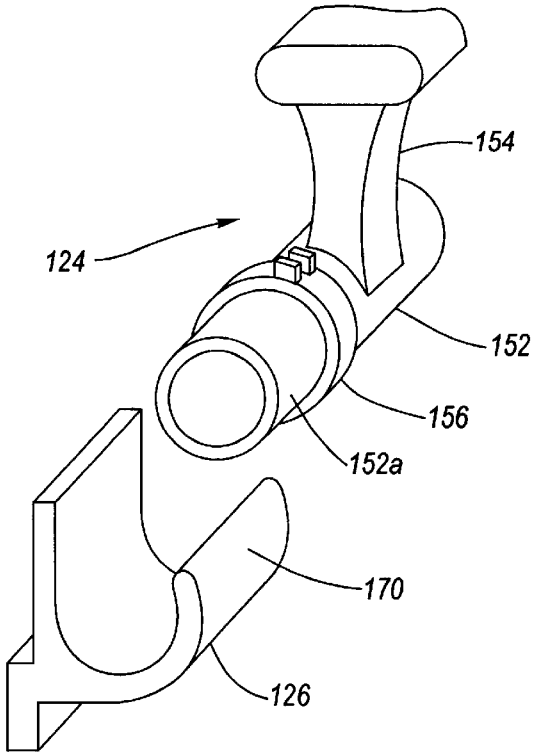
FIG. 9 is an exploded, broken-away perspective view of the handle and one of its seats according to the present invention.
Figure 10:
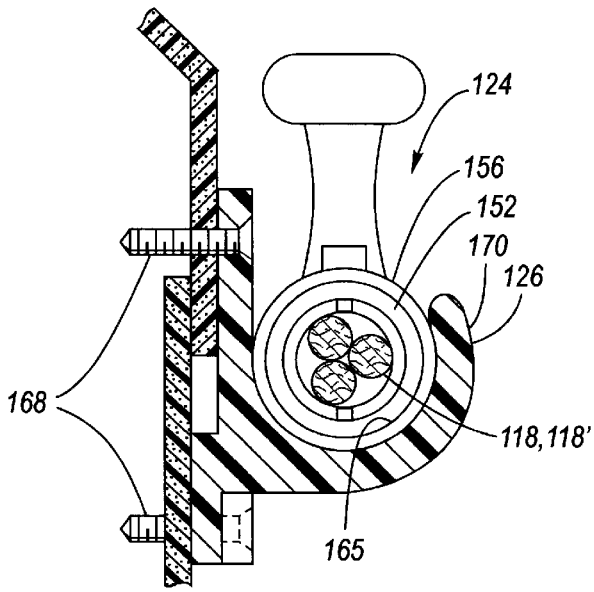
FIG. 10 is a partly sectional end view showing the handle snap fitted into one of its seats.
Figure 11:
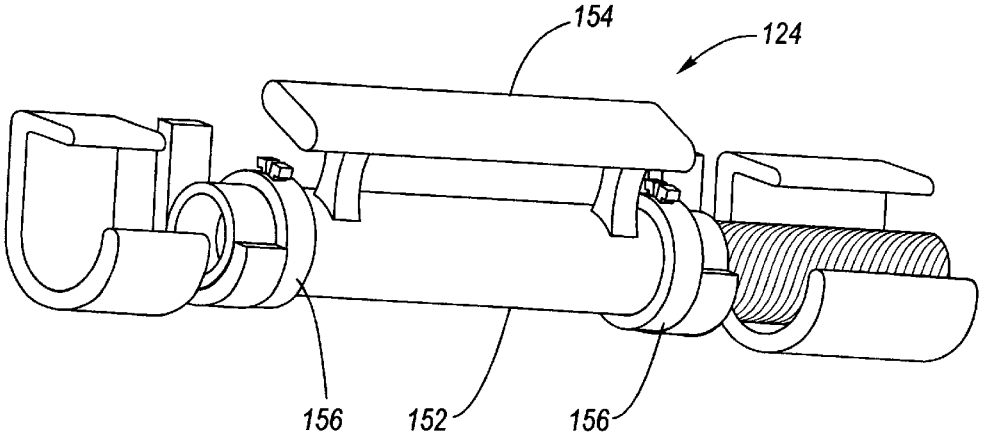
FIG. 11 is a broken-away perspective view of the handle snapped into its seats.

Referring now to FIGS. 6A and 6B, the guide member 130 will be further detailed.

Each guide member 130 includes a slot, 144', an internal hollow 142' and an upturn 148 adjacent the cleat 120. The upturn 148 is structured to snag the bow mooring line 118' as it is manipulated into entry with the rub rail mooring line receptacle 112', wherein a curvilinear facet 150 guides the bow mooring line 118' into the slot 144', whereupon it is received by the interior hollow 142'. Since the slot 144' and interior hollow 142' of the guide member 130 are aligned with the slot 144 and interior hollow 142 of the rub rail mooring line receptacle 112', the mooring line 118' will enter therein as the bow mooring line is pulled away from the cleat 120 and in general alignment with the rub rail mooring line receptacle, as shown at FIG. 6B.

A preferred material for the port and starboard rubrail mooring line receptacles 112, 112' is a sturdy, ultraviolet resistant material, as for example polyvinylchloride (PVC) having a hardness of 80–85 shore A. The bow mooring lines 118, 118' may be composed of any suitable line material used for nautical purposes, such as for example three strand nylon. The guide member 130 is preferably composed of an injection molded plastic.

Referring now to FIGS. 7 through 11, the handle 124 will be described with greater detail.

The handle 124 includes a cylindrical sleeve member 152 and a handle member 154 which is connected to the sleeve member, such as for example being a single piece of injection molded plastic. Spaced from each end of the sleeve member 152 is an annular ring 156. As shown best at FIG. 8, a grip members 158, having teeth 160, is situated in each cavity 162 of a pair of diametrically opposed cavities at each of the annular rings 156 and project into the cylindrical hollow 165 of the sleeve member 152.

The distal end portion 118*b*, 118*b'* of a mooring line 118, 118' is received into the cylindrical hollow 165 of the sleeve member 152 and held fast therein by engagement of the teeth 160 of the grip members 158. The grip members 158 include resilient ears 164, 166 which when squeezed, allow an abutment 168 thereof to pass through a restriction 170 in its cavity 162, and thereby radially move the teeth out of engagement with the mooring line 118, 118' (compare upper and lower views of FIG. 8). The adjustability of the grip members 158 allows for the bow mooring line 118, 118' to be periodically adjusted relative to the handle so as to keep it reasonably taught when the handle 124 is snappingly seated, as shown at FIGS. 1 and 3.

The seats 126, which are preferably formed of plastic, are secured at the gap 114 via fasteners 168, wherein the shape thereof generally mimics that of the adjacent rubrail mooring line receptacles, absent a flange member. A lip 170 thereof which curvably resembles the rub rail member snappingly receives the ends 152*a* of the sleeve member 152.

Operation will now be described referring to FIGS. 12A through 13C.

Each of the port bow and starboard bow mooring lines 118 have the proximate ends 118*a* thereof connected with a central bow eyelet 122 on the watercraft 102. Each bow mooring line is received into its respective rubrail mooring line receptacle 112. The respective handles 124 are snapped into place at the gap in the respective port and starboard rub rail mooring line receptacles via the seats 126.

Figure 12A:
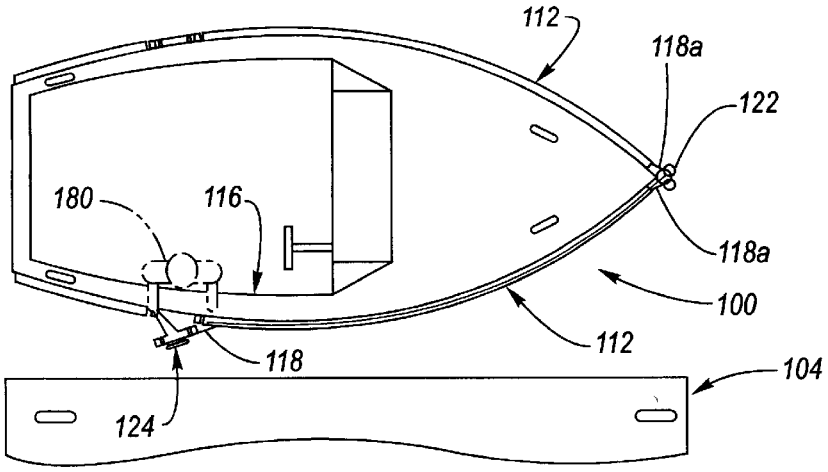
FIGS. 12A through 12C depict steps for docking a watercraft according to the first rubrail mooring line receptacle apparatus.
Figure 12B:
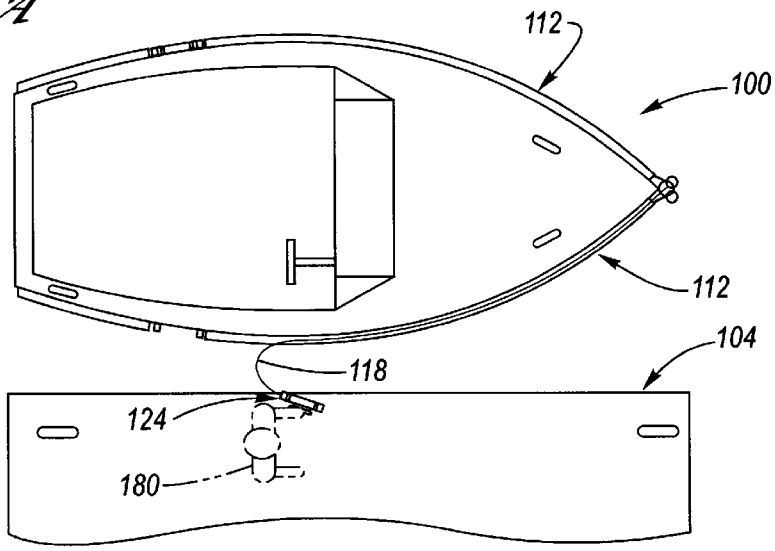
Figure 12C:
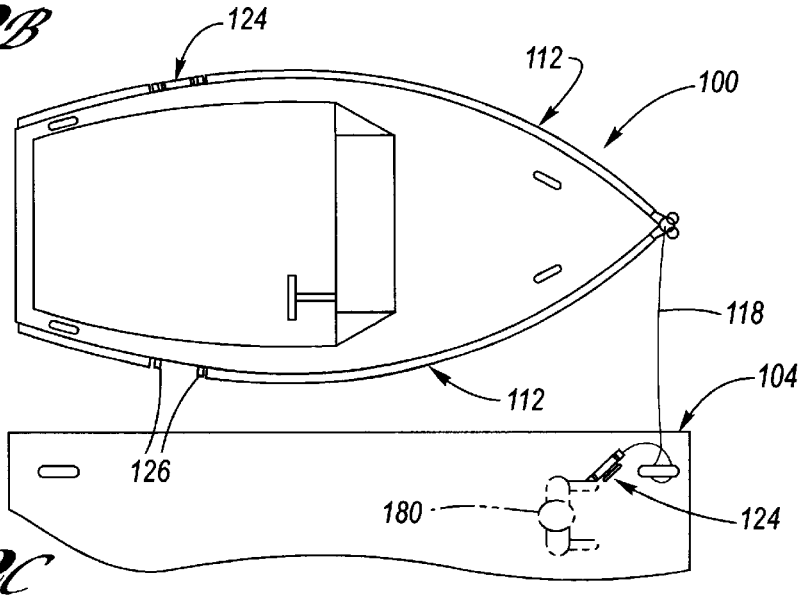

When docking, the skipper or a crew member 180 grabs a bow mooring line 118, via the handle 124 thereof, on the side of the watercraft facing a dock facility 104, exits the watercraft at the ingress/egress location 116, and then pulls upon the mooring line to thereby free it from its rubrail mooring line receptacle via exiting along the slot thereof, as shown at FIG. 12B. The person then secures that mooring line in a conventional way to the dock facility, such as for example at a dock cleat or dock piling, as shown at FIG. 12C. If appropriate, the other of the bow mooring lines is then grabbed at its respective handle and similarly deployed. The stern mooring lines are deployed in a conventional manner. In this regard, the stern mooring lines may be stored into a portion of the rubrail mooring line receptacles, per the disclosures incorporated by reference hereinbelow.

Figure 13A:
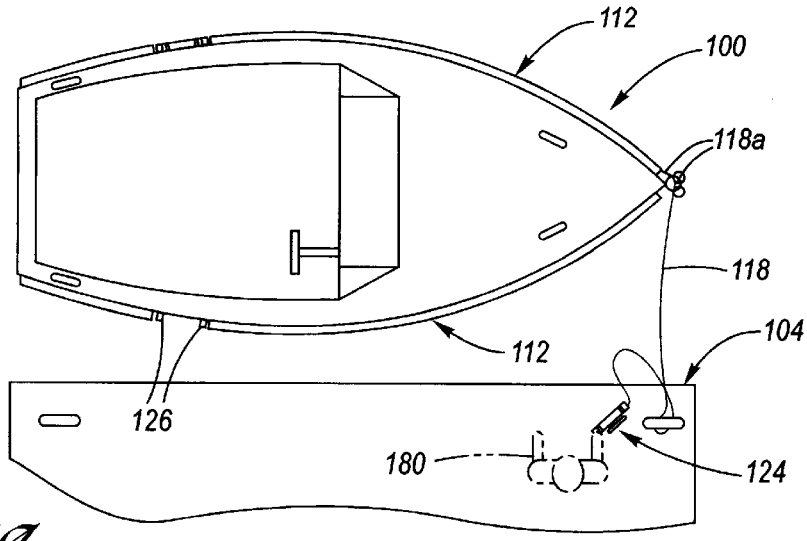
FIGS. 13A through 13C depict steps for undocking a watercraft according to the first rubrail mooring line receptacle apparatus.
Figure 13B:
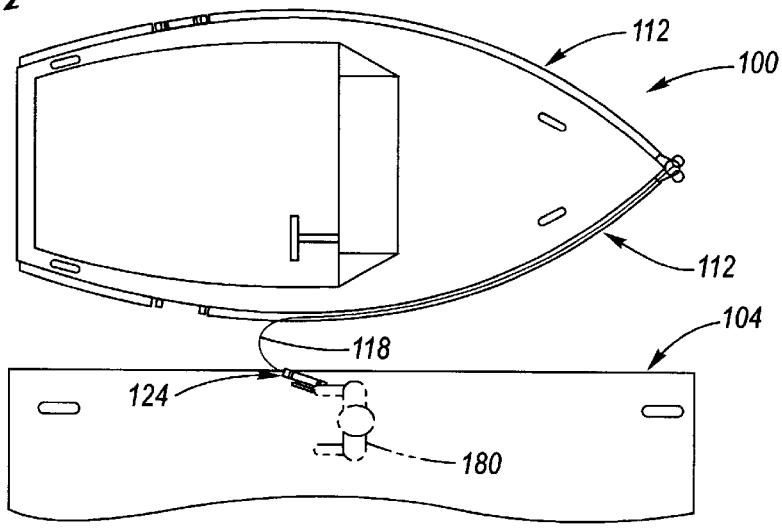
Figure 13C:
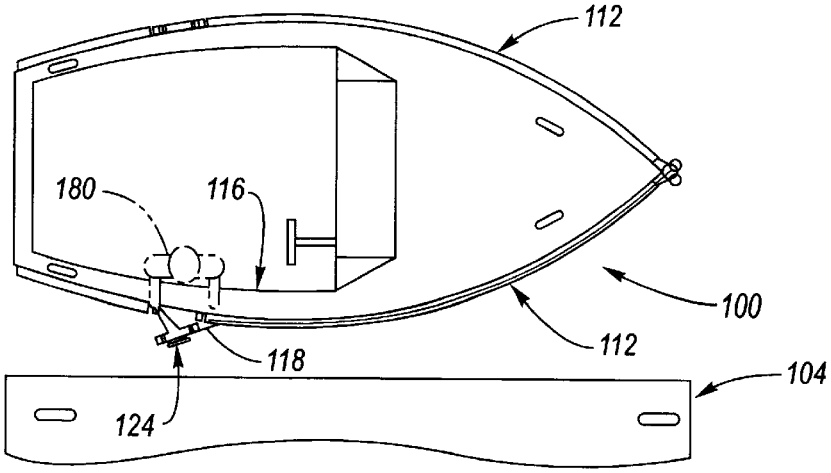

When it is time to shove-off, the mooring lines tied to the dock facility 104 are released therefrom, as shown at FIG. 13A, and the bow mooring line (or lines) is (are) then slipped progressively through the slot of its respective rubrail mooring line receptacle, as shown at FIG. 13B. Lastly, the person enters the watercraft at the ingress/egress location 116 and then causes the handle to be again snappingly seated in its seats 126, as shown at FIG. 13C for storage while the watercraft is underway, and later use when docking is to again take place.

In the case of the rubrail mooring line receptacle 100 wherein cleats 120 are used, a similar procedure is followed, with the additional aid of the guide members 130, as functionally described hereinabove.

It is to be understood that the various components recited hereinabove may be modified or substituted with analogously functioning parts. For example, an abutment member may be substituted for the handles which prevents the mooring line from being "lost" into the interior hollow of a rubrail mooring line receptacle. In this regard, the disclosure of the parent applications, Ser. No. 09/026,596, filed on Feb. 20, 1998, Ser. No. 08/791,973, filed on Jan. 31, 1997 and Ser. No. 08/540,081, filed on Oct. 6, 1995, which is now U.S. Pat. No. 5,598,805 are hereby incorporated by reference herein.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A rubrail mooring line receptacle apparatus for a watercraft, comprising:

at least one rubrail mooring line receptacle comprising:

a sidewall having a rear side and a forward side;

a rubrail member connected with said forward side of said sidewall, said rubrail member having an internal surface and an external surface, said external surface forming a rubrail bumper; and means for connecting said rear side of said sidewall to a watercraft at substantially the gunwale thereof, wherein said rubrail member is connected to said sidewall at a lower portion of said sidewall;

a bow mooring line having a near end and an opposite distal end, wherein said internal surface forms an interior hollow for restably receiving the bow mooring line; and abutment means for engaging a distal end of the bow mooring line and preventing the distal end thereof from sliding into the interior hollow.

2. The rubrail mooring line receptacle apparatus of claim 1, further comprising guide member means for guiding entry of said bow mooring line into said slot.

3. The rubrail mooring line receptacle apparatus of claim 1, further comprising a flange member connected with said forward side of said sidewall at an upper portion of said sidewall, a slot being formed between said flange member and said rubrail member which communicates with said interior hollow and through which said bow mooring line is passable.

4. The rubrail mooring line receptacle apparatus of claim 3, wherein said abutment means comprises:

a gap in said rubrail mooring line receptacle;

an abutment member connected to said distal end of said bow mooring line, wherein said abutment member comprises a handle member, a sleeve member for receiving said distal end of said bow mooring line, and adjustment means for selectively repositioning said abutment means along said bow mooring line; and snap means for snappingly retaining said abutment member at said gap.

5. The rubrail mooring line receptacle apparatus for a watercraft of claim 4, wherein said at least one rubrail mooring line receptacle comprises a starboard rubrail mooring line receptacle and a port rubrail mooring line receptacle.

6. A watercraft and rubrail mooring line receptacle apparatus, comprising:

a watercraft having a gunwale, a starboard side, a port side, a bow, and an ingress/egress location; and a starboard rubrail mooring line receptacle connected to said starboard side, and a port side rubrail mooring line receptacle connected to said port side, each of said port and starboard side mooring line receptacles comprising:

a sidewall having a rear side and a forward side;

a rubrail member connected with said forward side of said sidewall, said rubrail member having an internal surface and an external surface, said external surface forming a rubrail bumper;

means for connecting said rear side of said sidewall to the watercraft at substantially the gunwale thereof, wherein said rubrail member is connected to said sidewall at a lower portion of said sidewall;

a mooring line connection member mounted to the bow;

a starboard bow mooring line having a near end and an opposite distal end, said near end thereof being connected to said connection member, wherein said internal surface of said starboard rubrail mooring line receptacle forms a starboard interior hollow for restably receiving the starboard bow mooring line;

a port bow mooring line having a near end and an opposite distal end, said near end thereof being connected to said connection member, wherein said internal surface of said port rubrail mooring line receptacle forms a port interior hollow for restably receiving the port bow mooring line; and abutment means for engaging the distal end of the starboard and port bow mooring lines so as to prevent the distal end thereof from sliding into the respective starboard and port interior hollows.

7. The rubrail mooring line receptacle apparatus of claim 6, wherein each of said starboard and port rubrail mooring line receptacles further comprise a flange member connected with said forward side of said sidewall at an upper portion of said sidewall, a slot being formed between said flange member and said rubrail member which communicates with a respective starboard and port interior hollow and through which a respective starboard and port bow mooring line is passable.

8. The rubrail mooring line receptacle apparatus of claim 7, wherein said abutment means comprises:

an abutment member gap in said starboard and port rubrail mooring line receptacles at substantially the ingress/egress location;

a starboard abutment member connected to said distal end of said starboard bow mooring line;

a port abutment member connected with said distal end of said port bow mooring line, wherein each of said starboard and port abutment members comprise a handle member, a sleeve member for receiving said distal end of a respective starboard and port bow mooring line, and adjustment means for selectively repositioning said abutment means along the respective starboard and port bow mooring line;

starboard snap means for snappingly retaining said starboard abutment member at the abutment member gap in said starboard rubrail mooring line receptacle; and port snap means for snappingly retaining said port abutment member at the abutment member gap in said port rubrail mooring line receptacle.

9. The watercraft and rubrail mooring line receptacle apparatus of claim 6, further comprising:

a starboard bow cleat connected with said watercraft;

a port bow cleat connected with said watercraft;

a starboard bow gap formed in said starboard rubrail mooring line receptacle adjacent said starboard cleat;

a port bow gap formed in said port rubrail mooring line receptacle adjacent said port cleat;

a starboard guide member for guiding entry of said starboard bow mooring line into said slot of said starboard rubrail mooring line receptacle at said starboard bow gap;

a port guide member for guiding entry of said port bow mooring line into said slot of said port rubrail mooring line receptacle at said port bow gap.

10. The rubrail mooring line receptacle apparatus of claim 9, wherein each of said starboard and port rubrail mooring line receptacles further comprise a flange member connected with said forward side of said sidewall at an upper portion of said sidewall, a slot being formed between said flange member and said rubrail member which communicates with a respective starboard and port interior hollow and through which a respective starboard and port bow mooring line is passable.

11. The rubrail mooring line receptacle apparatus of claim 10, wherein said abutment means comprises:

a gap in said starboard and port rubrail mooring line receptacles at substantially the ingress/egress location;

a starboard abutment member connected to said distal end of said starboard bow mooring line;

a port abutment member connected with said distal end of said port bow mooring line, wherein each of said starboard and port abutment members comprise a handle member, a sleeve member for receiving said distal end of a respective starboard and port bow mooring line, and adjustment means for selectively repositioning said abutment means along the respective starboard and port bow mooring line;

starboard snap means for snappingly retaining said starboard abutment member at the gap in said starboard rubrail mooring line receptacle; and port snap means for snappingly retaining said port abutment member at the gap in said port rubrail mooring line receptacle.

12. A method for storing and using a mooring line of a watercraft comprising the steps of:

forming a cavity along a rubrail;

attaching the rubrail to a watercraft;

placing a mooring line of the watercraft into the cavity in order to store the mooring line; and removing the mooring line from the cavity to use the mooring line to moor the watercraft.

13. The method of claim 12, further comprising the step of replacing the mooring line into the cavity to again store the mooring line prior to repeating said step of removing.

* * * * *